United States Patent [19]

Hughes et al.

[11] 4,197,695

[45] Apr. 15, 1980

[54] METHOD OF MAKING SEALED WIRE ROPE

[75] Inventors: Charles R. Hughes, Hellertown; Louis A. Stanzione, Williamsport, both of Pa.

[73] Assignee: Bethlehem Steel Corporation, Bethlehem, Pa.

[21] Appl. No.: 849,568

[22] Filed: Nov. 8, 1977

[51] Int. Cl.[2] ..... D07B 7/14; D07B 1/06; D07B 1/16

[52] U.S. Cl. ..... 57/7; 57/217; 57/221; 156/48; 156/433

[58] Field of Search ..... 57/7, 162, 149, 164, 57/35, 217, 221; 156/47, 48, 51, 145, 166, 172, 500, 244.11, 296, 433, 441

[56] References Cited

U.S. PATENT DOCUMENTS

| | | | |
|---|---|---|---|
| 2,518,454 | 8/1950 | Elliot | 174/114 |
| 3,425,207 | 2/1969 | Campbell | 57/145 |
| 3,443,374 | 5/1969 | Carnevale | 57/162 X |
| 3,601,967 | 8/1971 | Wardley | 57/162 X |
| 3,639,567 | 2/1972 | Hervig | 264/45 |
| 3,681,510 | 8/1972 | Lemieux | 174/23 R |
| 3,681,911 | 8/1972 | Humphries | 57/162 X |
| 3,778,994 | 12/1973 | Humphries | 57/149 |
| 3,800,522 | 4/1974 | Hughes et al. | 57/162 X |
| 3,824,777 | 7/1974 | Riggs | 57/149 |
| 3,874,158 | 4/1975 | Chiappetta et al. | 57/149 |
| 3,882,665 | 5/1975 | Hughes et al. | 57/162 X |
| 4,033,800 | 7/1977 | Ollis | 156/48 |

*Primary Examiner*—John Petrakes

*Attorney, Agent, or Firm*—Joseph J. O'Keefe; Charles A. Wilkinson

[57] ABSTRACT

A corrosion resistant rope in which the individual strands are sealed with a plastic foam impregnant and surrounded with a dense unfoamed plastic material is made by applying a foamable plastic to the individual wires of a series of wire strands, or, alternatively, to the individual strands as a whole, and closing the strands into a rope in a closing die while passing a nonfoamable plastic material into the closing die. Sealed plastic foam impregnated wire strands can be made in the same manner by passing nonfoamable plastic material into the stranding die during fabrication of the strand.

6 Claims, 23 Drawing Figures

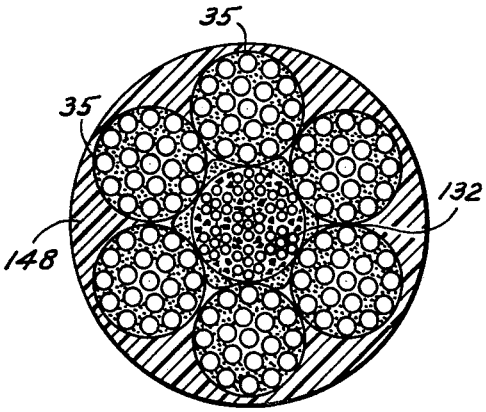
FIG. 11
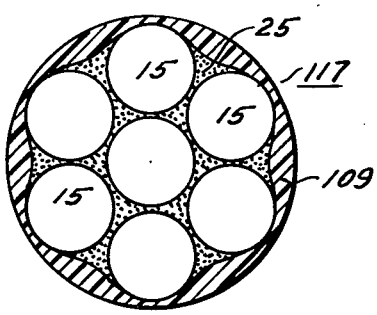
FIG. 12
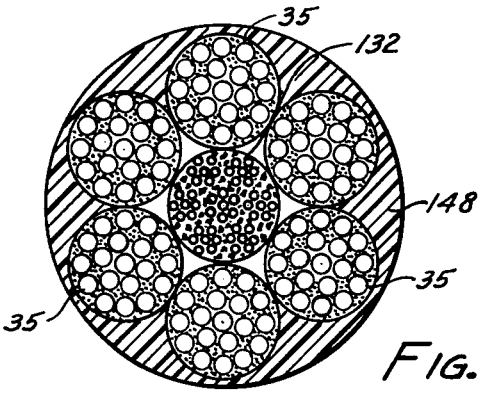
FIG. 13A
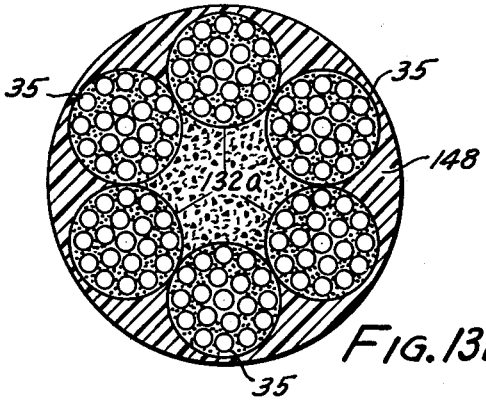
FIG. 13B
FIG. 14
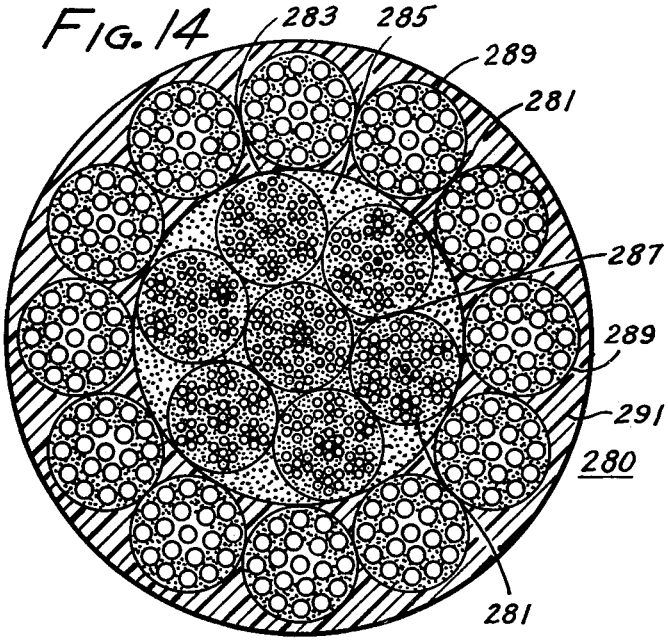
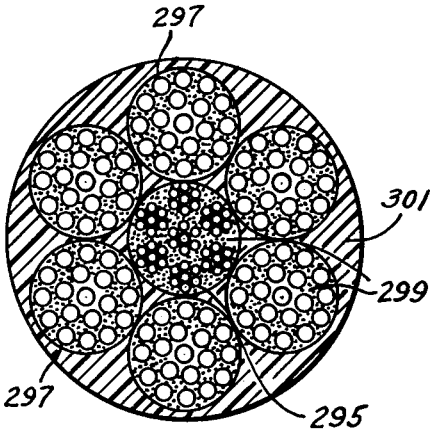
FIG. 15

METHOD OF MAKING SEALED WIRE ROPE

BACKGROUND OF THE INVENTION

This invention relates generally to the protection of wire ropes from corrosive conditions and more particularly to the sealing of wire ropes against corrosive environments by the use of plastic compositions including plastic foam compositions.

Various expedients have in the past been used to bar the entrance of water and moisture into the interior of wire ropes and strands. Such expedients have included the use of heavy lubricants, external plastic coatings and the encapsulation of individual wires, strands or even an entire wire rope in solid plastic sheaths. Lubricants are soon lost from an otherwise unprotected strand or rope while external protective coatings are subject to wear and upon rupture at any point will admit moisture to the interior of the rope or strand. Solid encapsulation, on the other hand, seriously interferes with the flexibility of the rope or strand and is, furthermore, difficult to attain.

U.S. Pat. Nos. 3,681,911 and 3,778,994 to D. V. Humphries and 3,800,522 to C. R. Hughes et al as well as several other recently issued patents disclose a successful alleviation of many of these previous problems. In these disclosures a working wire rope or a single working strand is impregnated with a liquid plastic composition during fabrication and said liquid is then converted to a flexible foam by the application of heat. The foam material is adherent to the individual wires and because of its cellular structure has a minimal effect on the flexibility of the rope or strand. The exterior of the rope or strand may be covered with a thin layer of the plastic foam or with a layer of denser unfoamed plastic or may more preferably be wiped clean, particularly in working ropes and strands, i.e. those which are used over sheaves and pulleys and the like or otherwise used in dynamic operations as opposed to static use such as guy lines and other types of permanent anchor lines. The bare wire surfaces resist abrasion and wear in these cases while the interior foam material between the individual wires, which preferably closely encloses all but the outer surfaces of the wires, prevents the access of water and moisture to the interior surfaces of the wires.

Where the rope or strand is used in static applications such as for guy lines and the like, it may be desirable to encapsulate the entire foam plastic filled rope or strand within a denser outer plastic sheath which may be applied by an extrusion operation or the like. Encapsulated plastic foam impregnated rope and strand is also useful for some working ropes and strands. The outer extruded sheath provides additional abrasion and corrosion resistance dependent upon the material of the sheath and also provides a smooth exterior surface on the rope or strand, which surface when formed with a smooth extrusion die opening forms a very desirable uniform sealing surface when a seal must be formed between the surface of the rope and some other object which the rope or strand contacts, for example, in passing through a wall or bulkhead or the like. The interior plastic foam material, on the other hand, prevents moisture and other corrosion inducing agents from gaining entrance to the interior of the rope or strand and being trapped within the interior if the outer plastic sheath is damaged by abrasion or the like.

Extruded external plastic sheaths have various disadvantages among which are the cost of the extrusion operation, additional stiffness of the rope or strand covered with a uniform tubular outer sheath, possible looseness of the sheath on the underlying rope causing sliding and wear when the extruded sheath is formed on a working rope and other disadvantages. The foremost disadvantage of an extruded sheath over the surface of a foam impregnated wire strand is the cost of the extra extrusion operation and the fact that a pressure type extrusion must be used if a uniform smooth outer surface is to be applied to the surface of a wire rope.

SUMMARY OF THE INVENTION

The foregoing disadvantages of the prior art methods of encapsulating foam filled wire rope have now been obviated by the present invention. In accordance with the present invention a wire strand or wire rope has an outer layer of dense smooth plastic applied to the surface of the strand or rope over an inner impregnation of foam plastic by coating the individual wires of a wire strand or the individual strands of a wire rope with a foamable plastic resin material, and passing the individual wires of the strand, or individual strands of the rope through a stranding or closing die into which is directed an unfoamable plastic material. The unfoamable plastic material collects about the outside of the strand or rope. The strand or rope is then passed through a heating device which heats the strand or strands and surrounding plastic resin material causing the foamable plastic to foam and impregnate the wire strand and to cure and the unfoamable plastic resin material to cure. Alternatively, the foamed plastic and unfoamed plastic can be cured in separate heating steps before and after passage through the closing die. The resulting strand or wire rope will be found to have the interstices between the wires of the strands impregnated with a foamed plastic material while the exterior of the strand or rope will be closely encapsulated with a concentric outer layer of dense plastic material forming a smooth outer layer on the rope or strand. In the case of both wire strand and wire rope and particularly wire rope, the valleys between the individual wires and/or between the individual strands will be thoroughly sealed by the dense plastic material providing a smooth rounded exterior to the rope or strand. In a wire rope in addition the individual strands will be largely separated from each other by a thin layer of encapsulating denser plastic while the outer valleys between the strands on the surface of the rope will be thoroughly filled with a dense plastic which provides a desirable smooth dense outer surface to the wire rope. The dense plastic on the surface and in the valleys between the strand seals the interior of the rope against external corrosive and abrasive agents, maintains the strands in factory established strand positions, and serves as a suitable surface for packing off or cleaning the rope. No supplementary external lubricant is necessary, eliminating a costly maintenance procedure and, for marine ropes, eliminating a source of water pollution. The strands at the same time are individually sealed with a soft, flexible plastic foam which prevents the ingress of corrosive fluid and serves as a binder and vibration damping medium. The outer dense sealing plastic while thoroughly filling the valleys between the individual strands of a wire rope does not form a thick layer over the tops of the individual strands and thus does not seriously decrease the flexibility of the rope as a whole. Consequently the improved outer seal of dense plastic is suitable for use on either working or static ropes or strands.

BRIEF DESCRIPTION OF THE DRAWINGS

FIG. 3A shows apparatus for coating the individual wires of the wire strand with foamable plastic material. FIG. 3B shows apparatus for closing the coated wires derived from the apparatus of FIG. 3A into a wire strand and FIG. 3C shows apparatus for closing the wire strands made in the apparatus of FIG. 3B into a wire rope in accordance with the present invention.

FIG. 4 is an alternative to FIGS. 3A and 3B.

FIG. 5A shows the application of a foamable plastic material to individual wires while FIG. 5B shows the closing and sealing of the wires derived from the apparatus of FIG. 5A into a foamed plastic impregnated sealed wire strand.

FIG. 11 shows a cross section of a wire rope formed in the apparatus shown schematically in FIG. 6.

FIG. 12 is a cross section of a wire strand made in the apparatus shown schematically in FIGS. 5A and 5B.

FIG. 13A is a cross section of a wire rope formed in the apparatus of FIG. 6 using the improved die of FIG. 6A.

FIG. 13B is a cross section of a wire rope formed in the apparatus of FIGS. 6 and 6A using a lubricated fiber strand core.

FIG. 14 is a cross section of a multi-operation wire rope made in an apparatus similar to the apparatus shown schematically in FIG. 8.

FIG. 15 is a cross section of a wire rope made in an apparatus such as shown in FIG. 8 in an alternative manner.

DESCRIPTION OF THE PREFERRED EMBODIMENTS

The present inventors have discovered that a wire rope or strand can be made with a desirably smooth even surface and an interior impregnation of foam plastic by applying an unfoamed but foamable plastic to the individual wires or strands of the strand or rope and then during stranding or closing the strand or rope injecting a non-foamable plastic material into the forming die. The wire strand or wire rope is then passed through a heating device, preferably an induction heating device, which heats the individual wires of the strand or rope causing the foamable plastic material to expand or foam and then cure and causing the non-foamable plastic material injected into the closing die to cure about the outside of the strand or strands. The resulting coating provides a smooth, even surface on the exterior of the strand or rope which is both wear resistant, pleasing in appearance and easily sealed against exterior structures. When forming a wire rope the individual strands can be made by applying foamable plastic either to the individual wires and foaming the plastic at the time the entire rope is foamed or, alternatively, the individual strands can be individually impregnated with a foamable plastic, cured, and these already foamed strands then laid up into a rope. The exterior unfoamable plastic material is injected into the closing die during closing of the individual strands into a rope and the unfoamable plastic is subsequently cured to form a pleasing, smooth, abrasion resistant exterior upon the wire rope.

Figures 1, 2, 3A, 3B, 3C, 3D:
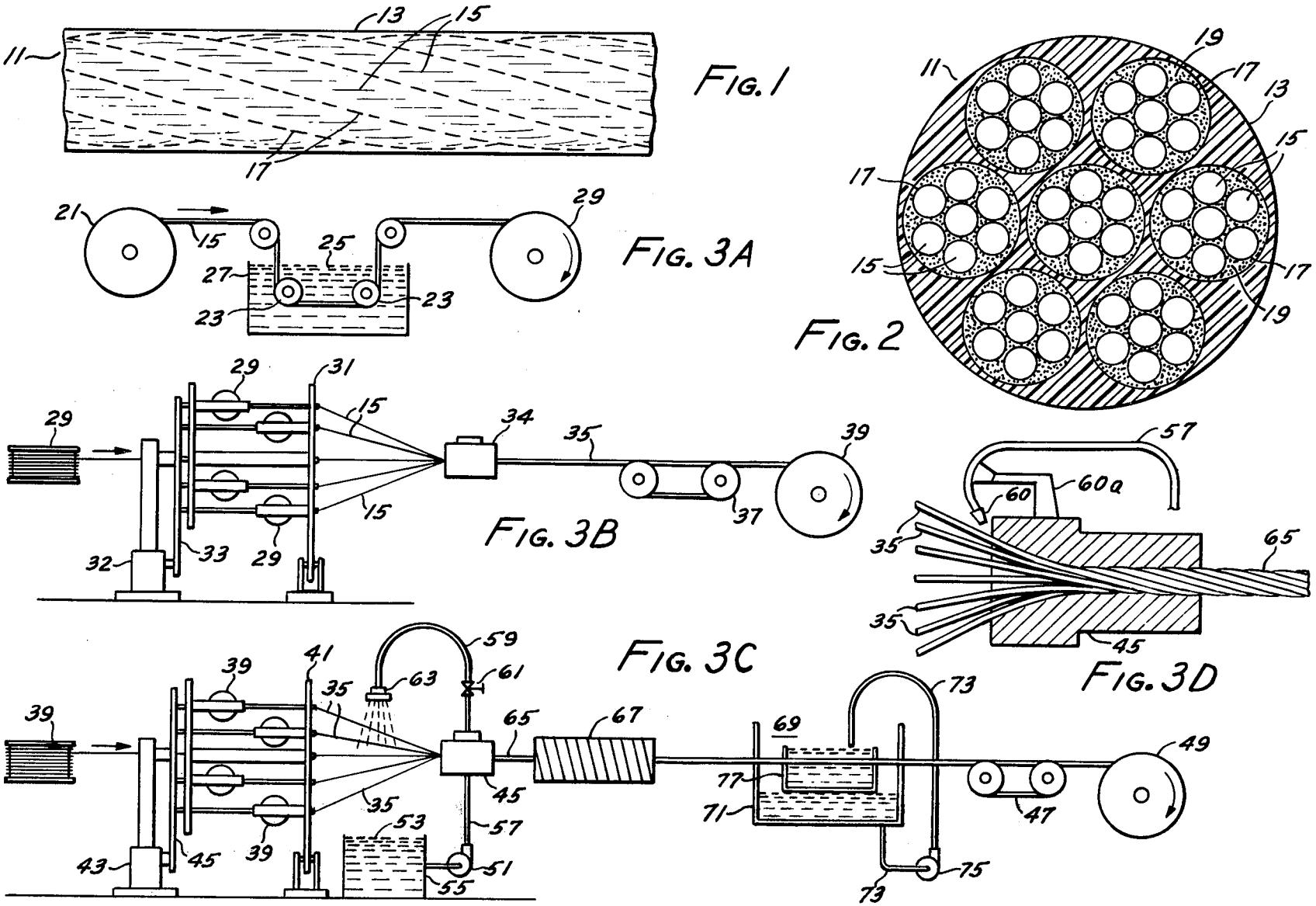
FIG. 1 is a longitudinal view of a wire rope made in accordance with the invention.
FIG. 2 is a cross section of the rope shown in FIG. 1.
FIG. 3A, 3B and 3C are a composite Figure schematically showing apparatus for manufacturing a rope such as shown in FIGS. 1 and 2.
FIG. 3D is a cross sectional view of an alternative arrangement for applying fluid plastic resin material to wire strands or the like as they are closed together into a wire rope in a closing die.

In FIG. 1 there is shown a longitudinal view of a wire rope 11 made in accordance with the present invention. The rope has an external layer of unfoamed sealing plastic 13 which forms a smooth exterior surface upon the wire rope. The tops of the individual wires of the individual strands can be seen adjacent to the surface of the plastic providing a regular spiral pattern about the wire rope 11. The tops of the individual wires are designated 15 while the overall spiral pattern formed by the wires of the strands on the surface of the rope is indicated as 17. The sealed wire rope has a pleasing, smooth, abrasion resistant outer plastic surface which can be easily sealed against adjoining structures.

FIG. 2 is a cross section of the rope shown in FIG. 1. In FIG. 2 may be seen the individual wire strands 17 of which the rope is made, the individual wires 15 of which each strand is made, the outer unfoamed plastic layer 13 as shown in FIG. 1 and, in addition, an internal plastic foam material 19 which impregnates each of the individual strands. The foam material 19 seals the strands against the intrusion of moisture and other corrosion inducing agents and prevents the migration of moisture longitudinally along the strands. The foamed material 19 does not significantly increase the stiffness of the strands. At the exterior of the strands and contacting the foam plastic material, which extends in FIG. 2 somewhat beyond the surface of the individual strands, there is an unfoamed plastic material 13 which serves in particular to fill in the valleys between the individual strands to form an outer regular contour to the rope surface and seal the foam plastic impregnated strands within the interior of the rope. In the rope illustrated in FIG. 2 the unfoamed plastic material also substantially surrounds each foam plastic impregnated strand, in effect separating each strand from the others except along their extreme peripheries. Thus, while individual wires of the strands may actually contact each other at their extreme peripheries as they spiral about each other, such actual contact is not visible in FIG. 2. The unfoamed or dense plastic material 13 provides a smooth, even and pleasing surface to the exterior of the strand.

It will be understood that while for convenience the individual outer strands 17 in FIG. 2 are shown completely overlain with a thin coating of both foamed and unfoamed plastic material, in actual practice the individual wires of the outer strands at their highest points will extend to the surface of the plastic or even a little through the plastic for a short distance as the wires traverse the surface of the strand. The spiral configuration of both the individual wires in the strands and the strands in the rope, however, cause each wire to approach the outer surface of the rope for only a relatively short distance along its spiral path. Thus in cross section the impregnated rope appears in general as in FIG. 2. However, in most cases the plastic will extend radially outwardly only to the periphery of the rope as a whole, or in other words, to the highest point of each outer wire.

Composite FIG. 3 schematically shows an apparatus for forming a foam impregnated sealed wire rope such as is shown in FIGS. 1 and 2. In FIG. 3A there is shown an apparatus for coating the individual wires from which the strands 17 are made with foamable plastic material. This apparatus consists of a payoff reel 21 which pays off wire over a series of guide sheaves 23 into a bath of a fluid foamable plastic material 25. The bath of foamable plastic material 25, which is held within an open top container 27, adheres to the wire as it passes through the bath and the coated wire is drawn from the bath onto a powered takeup reel 29. The foamable plastic material 25 will dry on the wire upon the reel 29, but will not cure without the application of heat, except in some cases over very long periods. As the reels 29 become filled with wire they may be set aside and stored until a sufficient number of reels are accumulated to form wire strand of the requisite number of wires.

It will be understood that the surface of the wire should be clean when exposed to the fluid plastic material in order to obtain good adhesion of the plastic to the metal. Most wire drawing compounds, for example, inherently have very poor parting or shear strength and if the plastic material is to adhere to the surface of the wire it cannot be applied without first removing residual drawing compound. Removal may be accomplished by a conventional alkaline cleaning bath, soap or the like. If the wires have been coated with a second metal layer, such as by a galvanizing operation, the coating operation will usually remove the drawing compound and the coated wires can be recoated with the plastic material directly over the first metal coating without an intermediate washing operation.

If the surfaces of the individual wires are clean and the plastic composition is one which is inherently adherent to metal surfaces or, alternatively, contains an adhesion promoting additive, the foam plastic and the unfoamed dense plastic will adhere to the surfaces of the individual wires, as well as being interlocked with the strand structure. A tight corrosion resistant seal is thus formed between the wires and the plastic which prevents migration of corrosive agents along the wires and seals the strand and rope against external corrosive environments. Adhesive plastics and adhesion promotion additives for plastics are well known to those skilled in the plastic arts and readily available commercially.

In FIG. 3B there is shown a stranding apparatus for stranding the wires coated in FIG. 3A into a wire strand. In FIG. 3B a series of wire storage reels or bobbins 29 are mounted in a rotatable flyer 31 which may be operated by motor 32 through a belt drive 33. An additional bobbin or reel 29 is mounted at the end of the flyer 31 to provide the center wire of the strand. The flyer 31 is rotated and the individual wires 15 are passed to a stranding die 34 where the individual wires are stranded into a strand 35 which is pulled through the die 34 by means of a capstan arrangement 37 and passed onto a storage reel or strand bobbin 39.

After a series of strand bobbins 39 are accumulated with the strand formed in FIG. 3B the bobbins 39 may be placed as shown in FIG. 3C in a second flyer 41 which is rotated and turned by a motor 43 through a belt drive 45. An extra strand bobbin is placed at the end of the flyer to provide the central strand of the wire rope. The storage reels 29 and 39 have for convenience been shown as the same as bobbins 29 and 39 on the flyers 31 and 41 respectively. It will be readily understood, however, that the storage reels might be, and usually are, large capacity reels and the bobbins smaller, and that an intermediate winding or transfer operation to wind the wire or strand from the storage reels to the bobbins may be used.

When the flyer 41 is rotated the individual strands 35 are pulled from the bobbins 39 through a closing die 45 by means of a capstan arrangement 47 and passed onto a storage reel 49. A pump 51 is provided to pump an unfoamable fluid plastic composition 53 from a tank 55 via a line 57 which discharges into the interior of the closing die 45. It will usually be sufficient to direct the unfoamable plastic material through the side of the closing die directly into the interior at any convenient point. If a sufficient quantity of unfoamable plastic is injected into the die it will surround all the strands passing through the die and thoroughly fill all the spaces between the strands as shown in FIG. 2. However, in some cases it may be desirable to inject the unfoamable plastic material into the closing die at several different points in order to assure an even distribution of plastic within the die as the strands of the rope are closed together in the die into the final wire rope. In some cases the plastic material may also be passed from the die through the line 59 and valve 61 to a spray head 63 positioned over the wires 35 and the plastic resin tank 53. Assuming that the valve 61 is open, excess unfoamable plastic will flow from the stranding die through the line 59 to the spray head 63 and will be deposited upon the strands 35 as they approach the stranding die 45. In this manner the strands 35 are substantially completely coated with a thin layer of unfoamable plastic material before they enter the closing die and a more complete layer of unfoamable plastic material is deposited upon the surfaces of the strands, particularly within the interior of the wire rope. Consequently, after the rope is cured, each individual strand will be substantially encapsulated within its own envelope of unfoamed plastic material. On the other hand, if it is principally desired to have the outer valleys between the strands of the wire rope filled with the unfoamed plastic material less emphasis is placed upon having each individual strand encapsulated with unfoamed plastic material. The valve 61 may in such cases be closed and the unfoamable plastic material injected only into the closing die 45. In such an instance a fair amount of unfoamed plastic material will still surround the individual strands, but a complete encapsulation of the strands may not be obtained. However, a good outer coating of unfoamed plastic material will be obtained about the outer circumference of the rope and the surface of the resulting wire rope 65 will be smooth and pleasing in appearance as well as abrasion resistant and suitable for close sealing against adjacent structures.

The line 59 has, for convenience, been shown attached to and receiving its supply of fluid plastic material from the interior of the closing die 45. It will readily be understood, however, that a separate connection could conveniently, and in many cases, desirably, be made between the lines 57 and 59 via the valve 61.

A somewhat simpler, but very convenient and practical, arrangement for injecting fluid plastic material into the closing die 45 is shown in FIG. 3D in which a nozzle 60 attached to the unfoamable plastic fluid line 57 is positioned by bracket **60*a* so that it squirts or directs unfoamable plastic directly into the opening of the die 45 as the strands 35 enter the die. A very satisfactory distribution of the plastic material about the strands is attained in this manner. While the same control of the plastic application is not attained as with the arrangement shown in FIG. 3C, the arrangement of FIG. 3D is a preferred arrangement where economy and reliability are the leading criteria. The arrangement of FIG. 3D may in general be used for the application of either foamable or unfoamable plastic material to linear material in either stranding or closing dies. As the strands 35 enter the die 45** excess plastic is extruded outwardly between the wires and excess plastic which falls from the front of the die and the strands may be caught and recirculated.

After leaving the closing die, or in a separate operation, the wire rope 65 passes through a heating device 67 which may preferably be an induction heating coil which serves to induce an elevated temperature in the component wires and strands of the wire rope, which elevated temperature is transferred to the plastic material causing the foamable plastic within the strands to foam and cure and causing the unfoamable plastic material to cure about the strands. After passing from the induction heating device 67 the wire rope passes through a cooling weir arrangement 69. In the cooling weir cooling water is passed from a tank 71 via lines 73 and pump 75 into a weir 77 through which the heated wire rope 65 passes. The cooling water after contact with the rope within the weir 77 drains from the ends of the weir back into the storage tank 71.

Figures 4, 5A, 5B, 16, 17:
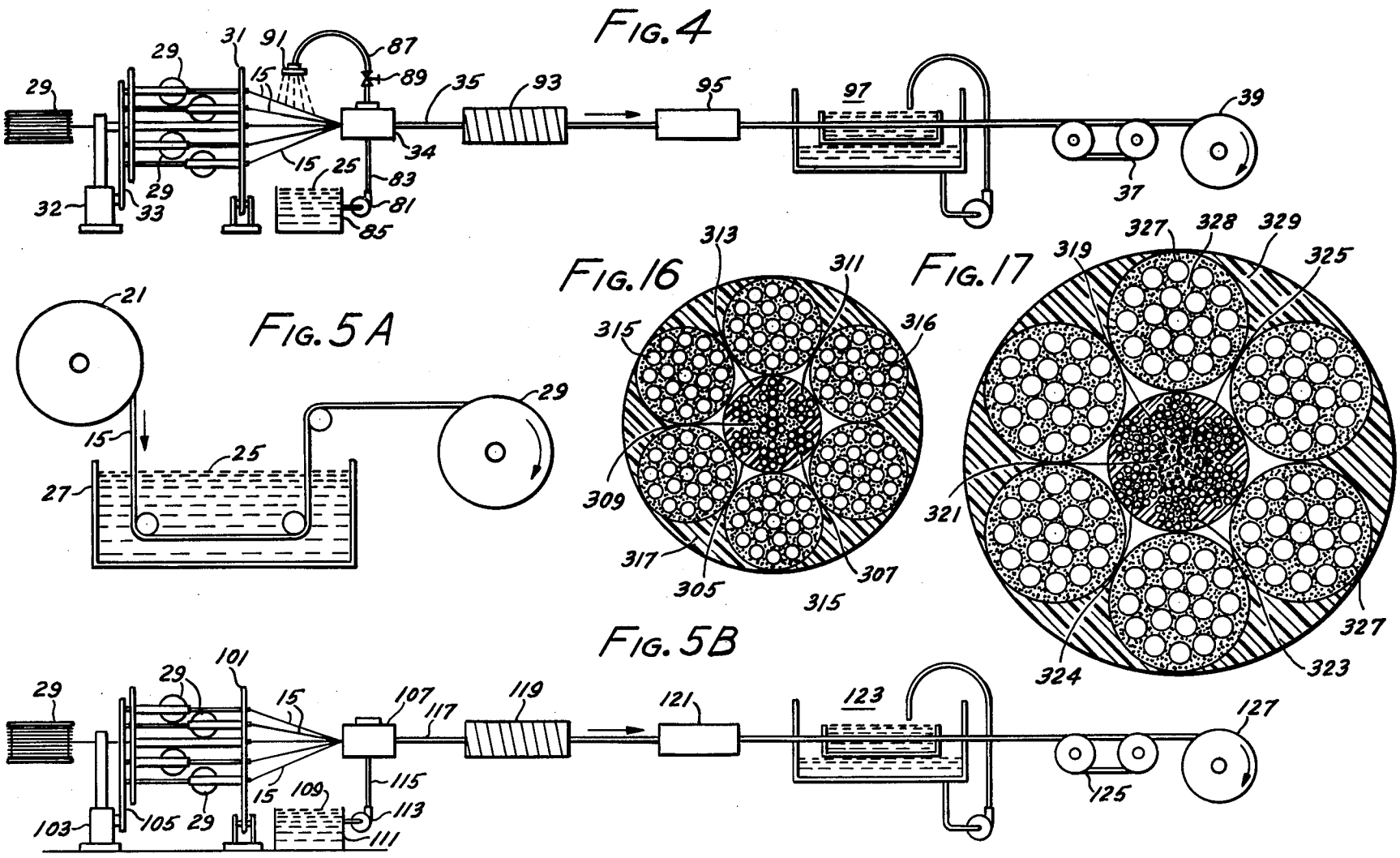
FIG. 4 schematically shows apparatus suitable for practicing an alternative method for making a wire strand impregnated with foamed plastic material prior to closing into a wire rope.
FIGS. 5A and 5B are a composite figure schematically showing an apparatus for making a sealed wire strand in accordance with the present invention.
FIG. 16 is a cross section of a further embodiment of wire rope made in the apparatus of FIGS. 7 or 8.
FIG. 17 is a cross section of a still further embodiment of wire rope made in the apparatus of FIG. 8.

In FIG. 4 there is shown an alternative wire stranding apparatus arrangement for making wire strand to be used in the rope made in the stranding device shown in FIG. 3B. In FIG. 4 there is shown a flyer apparatus which for convenience has been given the same numbers as the flyer shown in FIG. 3B and which is substantially identical with the flyer in FIG. 3B. The same strand bobbins 29 as used in the flyer 31 shown in FIG. 3B are mounted in the flyer shown in FIG. 4 and individual wires 15 are drawn by means of a capstan 37 through the stranding die 34. In the apparatus shown in FIG. 4 the stranding die 34 is provided with means for injecting into the die via a pump 81 and line 83 fluid foamable plastic material 25 from the tank 85. The plastic foamable material 25 is the same material as is contained in tank 27 shown in FIG. 3A. If desired, excess foamable material passing into the stranding die may pass into a further line 87 via valve 89, if open, to spray head 91. The foamable plastic material will pass from the spray head 91 down upon the wires 15 passing to the stranding die 34 adhering to the wires and passing with the wires into the die insuring that the wires are completely coated with the plastic foamable material. Excess foamable plastic material will fall past the wires or from the individual wires into the tank 25.

While FIG. 4 shows the use of the already coated wire 15 which has passed through the coating tank 27 shown in FIG. 3A, it will be understood that with the modification shown in FIG. 4 the prior coating step in the apparatus shown in FIG. 3A may not be necessary and may in many, if not most, cases be conveniently omitted. In such event clean uncoated wires may be placed on the strand bobbins and mounted in the flyer. The uncoated wires will be thoroughly coated as they approach the die 34 through the plastic spray from the spray head 91 and within the die 34. Alternatively, a die and coating arrangement such as shown in FIG. 3D may be used.

After the wires have been stranded together into a strand and passed from the stranding die 34 as a strand 35, the strand 35 will pass through a heating device which, as in FIG. 3C, may also preferably be comprised of an induction heating coil device 93 in which the individual wires are heated and the heat so induced in the wires is transferred to the plastic material causing the foamable plastic material to foam and cure about the individual wires thus forming a plastic impregnated wire strand.

Alternatively, the heating and curing operation may be conducted in separate operations or lines with an intermediate reeling and storage operation. A separate operation, of course, adds undesirable extra handling steps, but has the advantage of separating the stranding operation; which is often subject to frequent stops due to operating difficulties, and the curing operation which is difficult to start and stop smoothly.

The impregnated wire strand after curing may then be passed through a wiping die 95 which removes excess plastic foam material from the surface of the strand. The wiping die 95 may be either stationary or rotating as disclosed in prior patents. However, since the valleys between the individual strands are preferably to be filled in substantially completely to form a smooth even outer surface on the wire rope, a stationary die will usually be quite satisfactory. The die may be formed either from metal or more preferably from an elastomeric material such as a hard rubber or the like.

The strand 35 after passing through the wiping die 95 then passes through a cooling weir device 97 similar to the weir device 69 shown in FIG. 3C where the plastic coated cable is cooled and the plastic finally hardened into a plastic foam. The resulting strand will be completely impregnated with a plastic foam material and may after passage onto the reel 39 be mounted in the flyer shown in FIG. 3C for closing into a wire rope. The resulting wire rope will be formed of plastic foam impregnated wire strands surrounded by an outer layer of dense unfoamed plastic material with the valleys between the outer strands filled in by said plastic material. In large part each individual strand is also coated with and connected to adjacent strands through a dense plastic material. If the dense and foamed plastic are formed from the same or chemically compatible plastic resins the two layers will be adherent to each other. The rope structure is substantially similar to the previously described rope structure but will be found to have a more distinct dividing line between the foam impregnated wire strands and the surrounding dense unfoamed plastic encapsulation.

In composite FIGS. 5A and 5B there is shown schematically a suitable apparatus for forming a single wire strand which is impregnated in the interior with the foamed plastic composition and surrounded on the exterior with a dense unfoamed material. In FIG. 5A there is shown a wire 15 being coated with a foamable plastic composition in the same manner as is shown in FIG. 3 by passage through a container of foamable plastic material 25. The wire 15 after being coated with the foamable plastic material is wound upon the wire bobbin 29 and several of these bobbins are then mounted in a flyer 101 shown in FIG. 5B. The rotatable flyer 101 is rotated by the motor 103 through the belt drive 105. The individual wires 15 pass to a stranding die 107 into which there is injected during stranding a nonfoamable plastic composition 109 from a container 111. As in the previous FIGURES the nonfoamable plastic composition is pumped from the container 109 by the pump 113 and passed through line 115 into the stranding die 107. After the wires 15 are stranded together the resulting wire strand 117 passes to a heating device 119 which is preferably, as in the other embodiments, an induction heating coil which heats the individual wires of the strand 117. The heat from the wires is transferred to the foamable and nonfoamable plastic material in the strand causing the foamable material to foam within the interstices of the strand between the wires and then cure and causing the outer nonfoamable plastic material to cure or partially cure. The strand 117 then passes to a wiping die 121 which wipes and smooths the surface of the nonfoamable plastic. The strand then passes to a cooling weir arrangement 123 similar to the cooling weir shown in FIG. 3C. The plastic along with the strand in general is cooled to harden the plastic material and the strand then passes to the capstan 125 and is finally reeled upon the takeup reel 127.

The strand made by the apparatus shown in FIGS. 5A and 5B will appear in cross section as the strand shown in FIG. 12 which shows a 7-wire strand 117 having individual wires 15 coated on their interior surfaces with plastic foam material 25 and on the exterior of the strand with an unfoamed plastic material 109. The unfoamed plastic material 109 provides a very smooth surface on the strand and serves to completely fill in the interstices between the outer wires of the strand. The foamed plastic material within the interior of the strands, on the other hand, completely fills the remainder of the strand and prevents the migration of moisture or corrosion inducing agents through the strand while not significantly increasing the density and stiffness of the strand.

Figure 6:
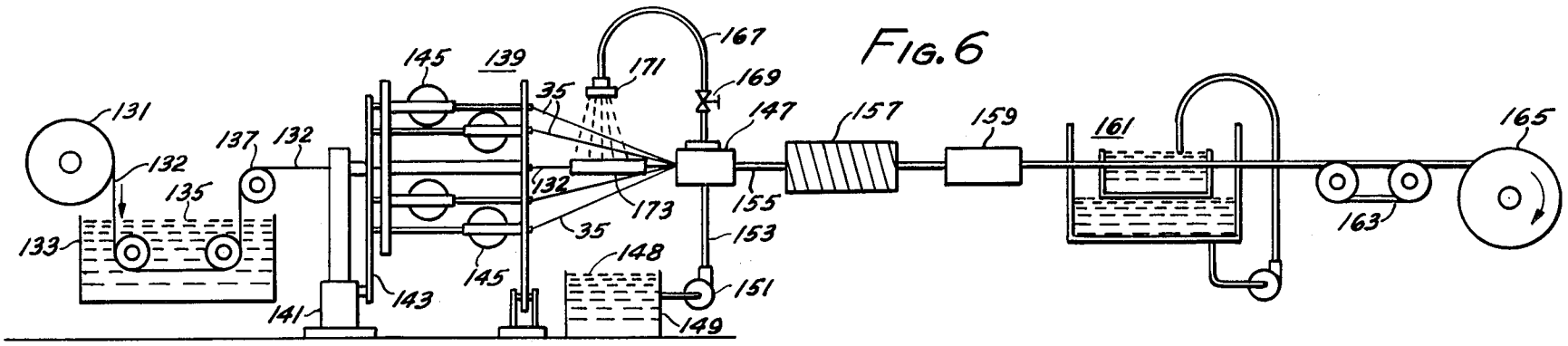
FIG. 6 shows schematically an apparatus suitable for making a foam impregnated sealed wire rope having a central lubricated wire rope core.

In FIG. 6 there is shown a suitable apparatus for forming a wire rope having a lubricated wire rope core. In FIG. 6 a wire rope core 132, which may be an independent wire rope core, but may also be a wire strand core, is paid off a payoff reel 131 into a tank 133 which contains a lubricating material 135. The lubricating material 135, which may be a lubricant having the consistency of a heavy grease or the like, thoroughly impregnates the rope core 132 and the rope core then passes over guide sheaves 137 to flyer 139 which may be rotated by motor 141 and a belt drive 143. Alternatively the lubricant can be applied to the core in a prior separate operation. Mounted upon the rotatable flyer are a series of strand bobbins 145 each of which will contain a wire strand which has been impregnated with a foamed plastic material by an operation and apparatus such as is shown in FIG. 4 or by the operations and apparatus shown in FIG. 7 described hereinafter for the manufacture of a two operation wire rope strand. These individual strands 35 are passed along with the lubricated rope core 132 to a closing die 147 where the foam plastic material impregnated strands 35 are closed about the lubricated wire core 132. At the same time an unfoamable plastic material 148 derived from a container 149 is pumped by the pump 151 and lines 153 to the interior of the closing die 147. The closed wire rope 155 is then passed to a heating device 157 which is preferably an external heating device such as a furnace of any suitable type rather than an induction coil. The heat supplied by the external heating device heats and cures only the external layers of unfoamed plastic material about the wire rope and the heat does not in the short time that the wire rope 155 is in the heating device have a chance to significantly reach the central lubricated strand, the lubricant of which might be harmed by excessive heat. While an external heating device is preferred, an induction heating device can in some cases also be used as a less desirable alternative. The outer plastic material is partially or completely cured by the heating device 157 and the rope 155 is then passed to a wiping die 159 which wipes the surface of the rope. The rope 155 will then pass to a cooling weir arrangement 161 where the plastic material and the entire rope is cooled and the exterior of the rope hardened. The rope then passes to a capstan device 163 and thence to a takeup reel 165.

The final wire rope made by the apparatus shown in FIG. 6 is shown in cross section in FIG. 11 where the lubricated wire rope core 132 may be seen surrounded by six foam plastic impregnated strands 35 and the whole surrounded by unfoamed plastic material 148. It will be noted that the individual foam impregnated wire strands 35 are two operation strands such as might be made in the apparatus shown in FIG. 7. However, the strands would frequently be single layer seven wire strands or multiple layer Seale or other type strands rather than two operation strands.

Figure 6A:
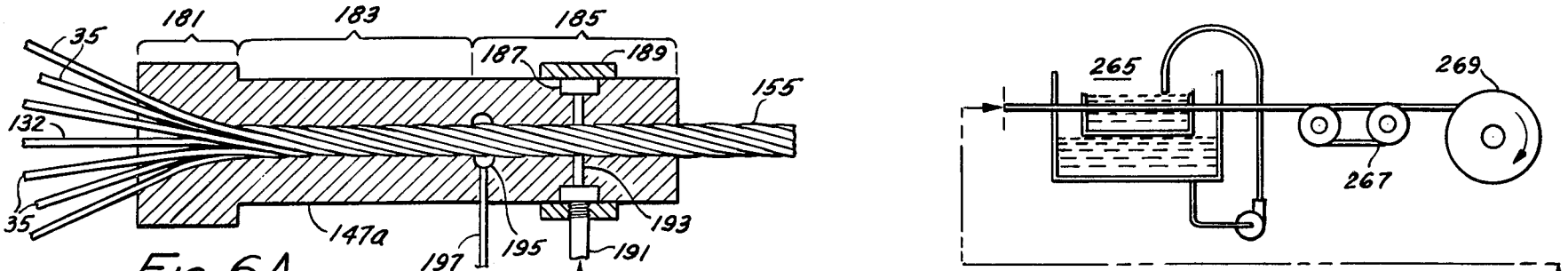
FIG. 6A is cross section of an improved die for use in the apparatus of FIG. 6.

In some cases the strands approaching the closing die 147 may also have the unfoamable plastic material 148 applied to them via the line 167, valve 169 and spray head 171. In such case it is also very desirable to have a shield 173 surrounding the central lubricated wire strand in order to protect the lubricated strand from the unfoamable plastic material falling from the spray head 171. If the spray head 171 is used more unfoamed plastic material will ultimately be found within the interstices between the outer foam impregnated wire rope strands and the inner lubricated wire rope core than would otherwise be found if all the unfoamable plastic material is applied within the closing die 147. Since the plastic material may, however, not be completely cured by the heat available without damage to the lubricated wire rope core, it will often be found desirable to close the valve 169 so that the extra plastic material is not applied in the same volume to the interior portions of the foamed impregnated strands. While some unfoamed plastic material will reach the interior of the strands when the plastic is injected solely into the closing die, the quantity will be less and the partial curing of this plastic material will normally do no harm. However, if it is desired not to allow any substantial unfoamed plastic material at all to reach the interior portions of the outer strands a die arrangement such as shown in FIGS. 6A may be used. It will normally not be satisfactory to use an arrangement such as shown in FIG. 3D since it is then very difficult to keep the plastic resin material away from the lubricated core.

In FIG. 6A there is shown in schematic cross section a special die 147*a* for use in place of the die 147 shown in FIG. 6. Closing die 147*a* has three main sections, an initial approach section 181 which is similar to the initial approach or closing section of a normal closing die and in which the individual wire strands of the rope are gradually forced closer and closer to each other about the central lubricated strand 132, a central compression section 183 where the strands are laid about each other in intimate contact and held compressed together for a short time in the form of the final rope, and a final plastic application section 185 in which the unfoamable plastic material is injected into the die about the outside of the strand. The initial closing section 181 and the central compression section 183 of the die are in the form found in the usual closing die such as the die 147 shown in FIG. 6. The final plastic injection section 185, however, is an additional section not found in normal rope closing dies. The plastic injection section 185 consists of an extension of the compression section 183 in which the strands of the wire rope are continuously compressed together in the form in which they are found in the final wire rope strand. An annular injection chamber 187 machined in the outside of the die surface is closed by a closure ring 189 through which a plastic injection line 191 is threaded. A series of plastic supply ports 193 lead from the annular injection chamber 187 to the plastic injection section 185 of the die 147*a*. An annular plastic drain orifice 195 separates the central compression section 183 from the final plastic injection section 185. A drain line 197 leads from the annular plastic drain orifice 195.

During operation of the die 147*a* the strands 35 and 132 are closed together into a wire rope 155 within the initial closing section 181 of the die and are then held in the final stranded rope form in the compression section 183. The rope 155 then passes into the final plastic injection 185 section where an unfoamable plastic 148 is injected into the die via the injection line 191, the annular injection section 187 and the plastic supply ports 193. Since the outer strands 35 of the wire rope are held tightly together in the plastic section 185 and the preceding central compression section 183 and since the strands are already impregnated with foam plastic material the injected unfoamable plastic material contacts only the outer surface of the rope. The plastic material 148 is evenly distributed about the surface of the rope filling the valleys between the outer strands and interlocking with the surfaces of the plastic foam impregnated strands. This unfoamable plastic material passes from the die with the rope 155 and would then be passed into the heating device 157 shown in FIG. 6. Alternatively, as explained above, the heating operation could be in a separate operation. If excess plastic is injected into the die to an extent such that plastic might be forced toward the central compression section, such plastic will be expelled from the interior of the die via the annular drain orifice 195 and will pass from the die through the plastic drain 197. Thus excess plastic material 148 does not have a chance to reach the initial closing section 181 of the die 147*a* where the plastic might surround the wire strands as they approach each other and be locked into the interior of the strand.

The final wire rope formed by the die 147*a* of FIG. 6A will appear in cross section as shown in FIG. 13A in which a central lubricated wire rope strand is surrounded by a series of outer plastic foam impregnated strands and the outer diameter of the rope and particularly the valleys between the outer strands is completely filled by the dense unfoamable plastic material 148. The interstices between the central lubricated wire rope core and the outer foam plastic impregnated strands is not filled as shown in FIG. 13A, but may tend to become filled with excess lubrication from the central wire rope core 132. The combination of the surrounding foam plastic impregnated strands 35 and the outer layer of dense unfoamed plastic material interlocked therewith will be found to very effectively lock the lubrication of the central lubricated core 132 within the wire rope. Since only the outer plastic material 148 is previously uncured, an external heating device such as a furnace or the like will be found quite sufficient to initiate the curing of this plastic material without heating the entire cable and possibly adversely affecting the lubrication of the central or core strand.

A wire rope having a lubricated fiber core could also be made in the die shown in FIG. 6A and would appear as shown in FIG. 13B which shows a central fiber strand 132*a* replacing the lubricated independent wire rope core 132 shown in FIG. 13A.

Figure 7:
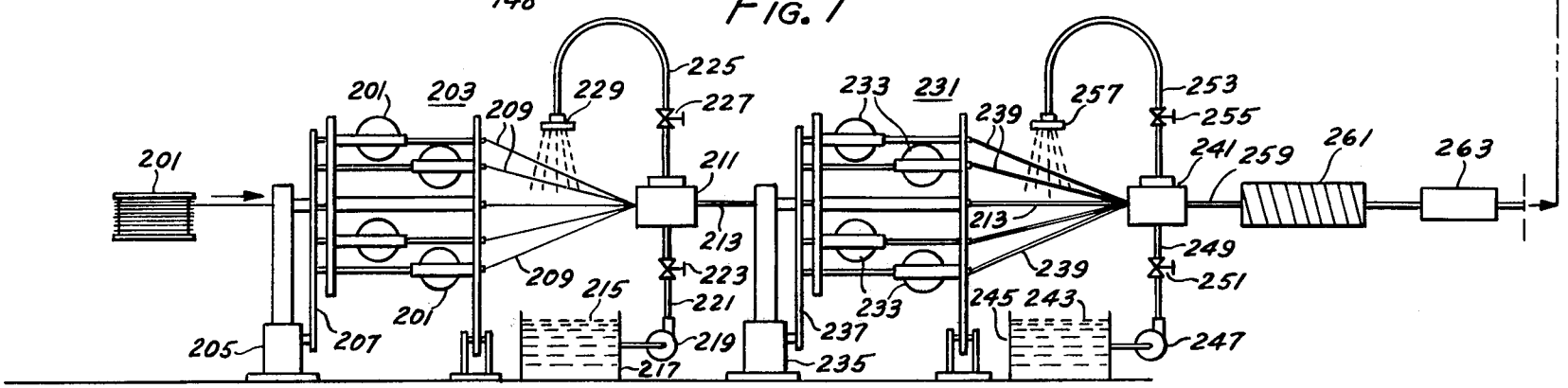
FIG. 7 shows schematically an apparatus suitable for making either two operation wire strand or a multi-operation wire rope in accordance with the present invention.

In FIG. 7 there is shown a further embodiment for the formation of a plastic foam impregnated wire strand having a dense outer unfoamed plastic coating. The apparatus shown in FIG. 7 has two stranding operations and therefore will form a multi-operation strand. In FIG. 7 a series of wire bobbins 201 are mounted in a rotatable flyer 203 which may be rotated by a motor 205 through a belt 207. The central wire of the strand is drawn from another similar bobbin 201 which is mounted before the rotatable flyer. The individual wires 209 are directed from the rotating flyer to a stranding die 211 where the wires are formed into a strand 213. Foamable plastic material 215 is injected into the closing die 211 from a supply of foamable plastic material in a reservoir 217 via a pump 219 and line 221. A valve 223 is supplied to regulate or restrict the flow of foamable plastic through the line 221. If desired additional foamable plastic material may be passed from the die via line 225 and valve 227 to a spray head 229 which directs the foamable plastic material upon the wires approaching the die 211. The strand 213 exiting from the die 211 will be thoroughly coated both internally and externally with a layer of foamable plastic material 215.

The strand 213 next enters a second flyer 231 in which there are mounted wire bobbins 233. The flyer 231 is rotated by a motor 235 through a belt drive 237. Individual wires 239 from the wire bobbins 233 pass from the rotating flyer 231 to the stranding die 241 which they are stranded about the strand 213. An unfoamable plastic material 243 is withdrawn from the reservoir 245 via pump 247 and line 249 and valve 251 and injected into the stranding die 241.

If desired additional unfoamable plastic material 243 may be passed from the die 241 via line 253 and valve 255 to a spray head 257 which sprays unfoamable plastic composition directly onto the surfaces of the wires 239 approaching the stranding die 241 and also about the outer surface of the central strand 213 which is already thoroughly coated and impregnated with foamable plastic material. The two operation strand 259 after final stranding passes from the die 241 to a strand heating device 261 which will preferably be an induction heating coil. Alternatively, the heating device can be in a separate line. The foamable plastic material within the central or first operation strand 213 is heated by the induction coil 261 through the heating of the individual wires of the strand and the outer unfoamable plastic material is also heated and at least partially cured by this heat. The two operation strand 259 then preferably passes to a wiping device 263 which further wipes and smooths the surface of the strand. The strand then passes to a weir type cooling device 265 where the plastic is cooled and hardened and the strand ultimately then passes over a capstan device 267 and is taken up on a takeup reel 269.

Figure 9:
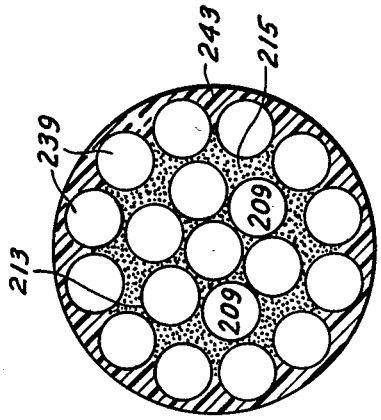
FIG. 9 is a cross section of a wire strand made in an apparatus such as shown in FIG. 7.

The final strand made in the apparatus shown in FIG. 7 will appear in cross section as seen in FIG. 9 wherein there is shown a central plastic foam impregnated wire operation surrounded by a second operation of wires 239 and a final outer coating of unfoamed plastic material 243 which thoroughly fills the valleys between the individual wires and forms a smooth outer surface upon the strand.

It will readily be understood that if the second container 245 in FIG. 7 is filled with a foamable plastic composition rather than an unfoamable plastic composition and such foamable composition is injected into the second operation closing die 241 a foam impregnated two operation wire strand suitable for use in the rope shown in FIGS. 11 or 13 will be produced.

It will also be readily recognized by those skilled in the wire rope and strand arts that the two flyers 203 and 231 in FIG. 7 could be coupled together in a conventional manner to operate as a single rotating unit and form a Seale type strand in which the individual layers of wire all have the same lay and the outer layers of wires fit down into the interstices between the wires of the inner layers.

Figure 8:
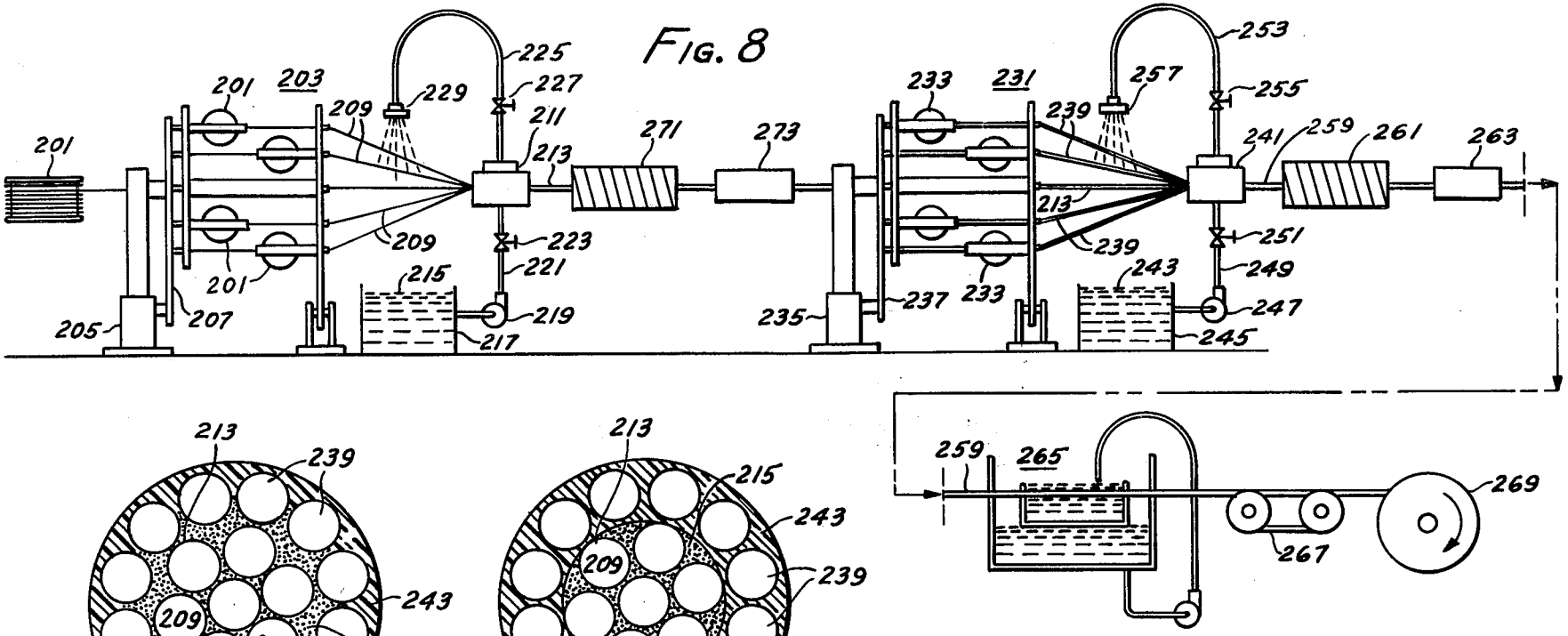
FIG. 8 shows schematically an apparatus suitable for making a multi-operation plastic foam impregnated sealed wire rope or strand by an alternative method.

In FIG. 8 there is shown a second embodiment of apparatus for making a foam plastic impregnated strand having a dense outer unfoamed plastic layer in accordance with the present invention. The apparatus shown in FIG. 8 comprises essentially the same apparatus as shown in FIG. 7 and the same numbers have been given to the same apparatus components. The addition, however, of a heating device 271 between the stranding die 211 and the flyer 231 with a wiping die 273 following the heating device 271 provides a means for forming an independent foam plastic impregnated initial strand operation about which a series of outer wires may then be laid while at the same time applying dense unfoamable plastic to form an outer layer of dense plastic material surrounding the inner layer of plastic foam impregnated strand. The outer dense unfoamed layer has the series of wires of the outer operation of wires running through it. In this manner a more complete division between the foam plastic layers and the outer dense layers is obtained and a better interlocking between the outer dense unfoamed plastic and the outer wires is obtained.

Figure 10:
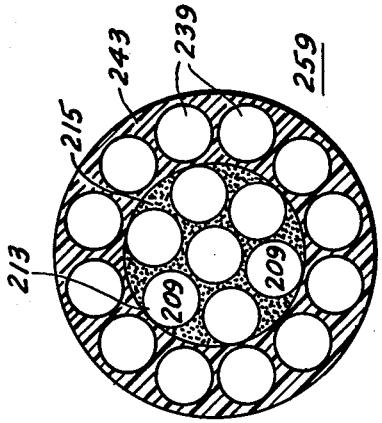
FIG. 10 shows a cross section of a plastic foam impregnated wire strand formed in the apparatus shown schematically in FIG. 8.

In FIG. 10 there is shown a schematic cross section of a wire strand made in the apparatus of FIG. 8. In FIG. 10 there is a central operation or core strand 213 made up of individual wires 209 which have been stranded together into the central strand 213 in the stranding die 211. The central strand 213 is thoroughly impregnated with a foamed plastic material 215 which has been foamed and at least partially cured in the induction furnace 271 and the surface smoothed in the wiping die 273. About the central strand 213 there has been laid an outer operation of wires 239 to form the outer layers of the final strand 259. The outer operation of wires 239 have been laid about the central strand 213 in the stranding die 241 of FIG. 8 and have been thoroughly surrounded at the time of closing by an encapsulation of dense unfoamed plastic material 243 applied in the die 241 and also pre-applied to individual wires 239 and about the central strand 213 by the spray head 257. It will be seen that due to the foaming and partial curing of the foamable plastic material 215 between the operations and the subsequent laying down of the dense unfoamed outer plastic materials in the outer operation of wires 239 in the second operation stranding die 241 there is a fairly distinct inner separation between the foamed plastic material impregnating the central strand 213 and the dense unfoamed plastic material 243 surrounding the outer operation wires 239. This construction may be compared with the wire strand shown in FIG. 9 which was made in the apparatus shown in FIG. 7. In the strand shown in FIG. 9 the foam plastic material applied to the central strand was expanded at the same time that the outer plastic material was beginning to cure and the central foam plastic material therefore tended to force the outer dense plastic material which surrounds the outer wires 239 closely into the interstices between the wires. As a result it will be seen that the central plastic foam material extends partially between the outer individual wires 239 while all the interstices between the outer wires are essentially filled with dense unfoamed plastic in FIG. 10. In some instances the construction shown in FIG. 9 may be an advantage in that there is more foam plastic material in the strand and the strand therefore may be more flexible due to having a thinner outer dense plastic coating. On the other hand, the cable structure shown in FIG. 10 in many cases will have an advantage in that the dense plastic material 243 is more thoroughly interlocked with the outer operation wires 239 forming a more unitary outer structure. In those cases in which a maximum amount of foam plastic is desired in the cable with a minimum amount of dense plastic material in the lower portions of the outer operation of wires, the valve 255 in FIG. 7 may be closed so that the supply of unfoamable plastic material 243 to the spray head 257 is interrupted. In this case a larger percentage of unfoamable plastic material will be applied to the outer portion of the outer operation wires and less is applied to the inner portions of the outer operation wires. If the dense unfoamed plastic material is desired only on the outside of the wire strand a die similar to the die shown in FIG. 6A may be substituted for the normal stranding die 241 so that the outer operation of wires is completed about the inner strand before the unfoamed plastic material 243 is applied in the die to the exterior of the strand. It will be recognized that as an alternative two separate dies could also be used, the first one a normal stranding die followed immediately by a special die in which unfoamable plastic is injected about the exterior of the strand while the wires are held tightly together in the form of the final strand.

In FIG. 14 there is shown a multi-operation wire rope 280 which has been made in an apparatus for closing rope similar to the apparatus for stranding wire strand shown in FIG. 8. It will be noted that in FIG. 14 a central operation of wire strands 281 have been formed into an independent central rope operation 283 which is completely impregnated with a foamed plastic material 285. This foamed plastic material 285 completely impregnates both the individual wire strands 281 and the interstices 287 between the strands 281. About the central or core rope 283 there is laid a second operation of wire strands 289. These second or outer operation strands 289 are preferably also individually impregnated with plastic foam material, but are surrounded by an unfoamed plastic material 291. Just as the unfoamed plastic material 243 in FIG. 10 extends between the outer wires of the second operation of wires 239, so in FIG. 14 the unfoamed plastic material 291 extends between and substantially surrounds the individual outer foam impregnated wire strands 289 thoroughly encapsulating the strands and protecting them from the outer environment while provide a smooth dense surface to the wire rope as a whole. The individual foam impregnated inner operation wire strands 281 and outer operation wire strands 289 of the wire rope 280 shown in FIG. 14 may be conveniently made in the apparatus shown in either FIGS. 3A and 3B or 4, if the strands are two operation strands as illustrated, in the apparatus of FIGS. 7 or 8 using a foamable plastic material in the second stranding die 241 in place of the unfoamable material as explained above. It will be understood that these individual wire strands would then be placed upon the bobbins 201 and 233 of apparatus similar to the flyers 203 and 231 shown in FIG. 8 in place of the wire bobbins which are actually shown in these FIGURES.

It will also be recognized that if desired the outer strands 289 rather than being foam impregnated could be also impregnated with the unfoamed plastic material. While this would tend to make a much stiffer rope section as a whole it would not be completely objectionable in many very large rope structures since the central operations of the rope would be completely impregnated with plastic foam material and would be quite flexible. Also where the rope must be used not as a working wire rope but as a static wire rope used as a guy line or the like, the additional stiffness of the outer section of the rope completely impregnated with unfoamable plastic material might not be a disadvantage at all and, in fact, could provide desirable additional stiffness to the static rope as a whole.

A two operation wire rope in which the central operation or core strand is comprised of an independent wire rope core, i.e. a small separate or independent wire rope, can also be made in an apparatus such as shown in FIG. 8. In this case the small wire strands of the independent wire rope core which have already been impregnated with foamable plastic are further impregnated with additional foamable plastic material as they pass through the die 211 and this foamable plastic material is then foamed in the induction coil 271 and wiped down in the wiper 273. A series of outer already foam impregnated wire strands are then closed about the independent wire rope core in the die 241 and are thoroughly surrounded with dense unfoamable plastic material in this closing die, particularly if the spray head 257 is allowed to operate during the closing of the outer operation strands about the central independent wire rope core. The impregnating arrangement shown in FIG. 3D could also, of course, be used. A wire rope made in this manner is shown in schematic cross section in FIG. 15 where 295 is the foam impregnated independent wire rope core or IWRC, 297 indicates the outer wire strands, 299 indicates the plastic foam material completely impregnating the central IWRC and the outer wires strand 297, and 301 indicates the unfoamed plastic material which completely surrounds the outer foam impregnated wire strands 297. It may be seen in FIG. 15 that the outer dense unfoamed plastic material 301 is thoroughly interlocked about the surface of the foam impregnated outer wire strands 297.

A further useful and corrosion resistant type of sealed wire rope can also be made in the apparatus shown in either FIG. 7 or FIG. 8 by applying an unfoamable plastic resin material in the first closing die 211 about a series of previously foam plastic impregnated wire strands which are initially stranded together to form an independent wire rope core, or IWRC, and then closing an outer operation of previously foam impregnated wire strands about the IWRC in the second closing die 241 while directing a dense unfoamable plastic into this die. A rope having both the outer operation of wire strands and the central IWRC foam impregnated and sealed with an outer layer of dense unfoamed plastic will result. The foam plastic impregnated strands may be either cured prior to forming the final rope or may be cured at the same time the rope as a whole is cured. In the latter case it is desirable to restrict the amount of foamable plastic applied to the individual strands and particularly the strands which will be used in the IWRC, which normally contains a fair amount of free space, in order to prevent the expansion of the internal foam from blowing or expelling the dense unfoamed plastic from the interstices between the strands at the surface of the IWRC.

A wire rope made with a dense unfoamed plastic at both the surface of the IWRC and the surface of the rope as a whole is shown in FIG. 16. In FIG. 16 an IWRC 305 is formed from six individual wire strands 307, each of which is impregnated with a foamed plastic 309, closed about a central foam plastic impregnated wire strand 311. A dense unfoamed plastic resin 313 fills the valleys between the outer strands 307 of the IWRC 305. A series of ninteen wire strands 315 impregnated with a plastic foam material 316 are closed about the foam impregnated sealed IWRC 305 and the valleys between the outer strands 315 are also filled with a dense unfoamed plastic 317. The dense plastic resin 313 filling the valleys between the outer strands 307 of the IWRC 305 not only serves to additionally seal the IWRC from corrosive agents, but provides additional resistant bearing material upon which the outer strands 315 of the wire rope are supported.

It is desirable, as mentioned above, if a distinct outer layer of dense plastic resin between the valleys of the outer strands of the IWRC is desired, to either prefoam the individual strands 307 in an apparatus such as shown in FIG. 4 or to restrict the amount of foamable plastic applied to the strands. This will prevent the plastic foaming in the IWRC during curing from expelling the still liquid dense unfoamed plastic from between the outer strands and mixing it together with the foam plastic in the interstices between the outer strands of the IWRC and the inner portions of the outer strands. In some instances, however, it may be convenient from a production standpoint to allow the foamable and unfoamable plastic to mix during foaming at the surface of the IWRC forming a somewhat denser combination of half foam-half dense plastic.

In FIG. 17 there is shown a still further embodiment of the invention similar to that shown in FIG. 16 in which the core of a wire rope is formed from a separate wire rope. The separate rope is formed from a central fiber core 319 impregnated with a lubricant 321.

A series of wire strands 323 impregnated with a plastic foam 324 are closed about the lubricated core 319 and the valleys between these strands are filled with a dense unfoamable plastic 325. As in FIG. 16 a series of nineteen wire strands 327 impregnated with a plastic foam resin material 328 are closed about the strands 323 and the valleys between these outer strands 327 are filled with a dense unfoamed plastic 329. In the rope shown in FIG. 17 the dense nonfoamed plastic 325 in the valleys between the outer strands of the core aids materially in maintaining the lubricant 321 within the central fiber core 319 as well as providing additional stiffness and bearing support to the outer strands 327.

The plastic foam can be any suitable composition such as vinyl plastic, for example, polyvinyl chloride having an organic nitrogen compound such as azodicarbonamide as a foaming agent. This foaming agent when heated above its decomposition temperature decomposes into nitrogen and carbon dioxide and expands the plastic into a foam. Another suitable composition would be a foamable polyurethane consisting of a thermosetting elastomer filled with expandable plastic beads. When exposed to heat the plastic of the beads softens and an entrapped gas therein expands the elastomer into a foam. The polyurethane elastomer matrix is cross linked during curing. Any other plastic composition which is flexible, chemically resistant to the environment and capable of being expanded into an impervious foam may be used to impregnate the strand. Vinyl plastisol compositions with additives to induce adhesion to the wires have been found to be particularly convenient and effective.

The unfoamed plastic resin material may be of the same general composition as the foamed plastic, but without the foaming agents added, or any other suitable compatible plastics.

The term curing has been used broadly throughout the specification to indicate final conditioning of the plastic material for use. The actual mechanism of curing will vary dependent upon the plastic being used and may include cross linking, polymerization, solution phenomena and other mechanisms. Vinyl plastisols have been found to be particularly convenient for use in wire rope and stranding coating operations because in plastisols curing is essentially a solution phenomena and curing of the plastic can be interrupted for long periods or effected repeatedly without deleterious effects upon the final plastic. Where curing involves cross linking and the rope or strand or portions thereof are heated successively it may be necessary to ensure that the initial heating effects only partial curing so that any later heating does not cause excessive cross linking or curing.

While particular apparatus types have been illustrated as suitable to make the impregnated strand of the invention in the manner described, those skilled in the art will readily realize that other forms and arrangements of apparatus could be used. For example, while one and two operation stranding operations have been described additional stranding or closing operations could also be used where appropriate or desirable. Likewise, while the use of planetary stranding machines is illustrated, so-called tube stranders or closers could also be used where appropriate.

We claim:

1. A method of making a sealed wire rope having a smooth exterior surface and having each strand impregnated with a plastic foam material and substantially separated from adjacent strands by a dense non-foamed plastic material of substantially the same composition as the plastic foam material comprising:

(a) impregnating an uncured foamable plastic resin material individually into a plurality of wire strands, (b) closing the uncured foamable plastic resin containing wire strands together into a wire rope in a closing die while injecting an uncured nonfoamable plastic resin material having substantially the same composition as the uncured foamable plastic material into the closing die at a point prior to complete closing of the strands together and in sufficient quantity to substantially completely encapsulate the uncured foamable plastic containing wire strands with uncured nonfoamable plastic resin material, and (c) passing the wire rope together with the uncured foamable and uncured unfoamable plastic resin compositions through a heating device to foam and cure the foamable plastic resin and cure the unfoamable plastic resin.

2. A method of making a sealed wire rope according to claim 1 additionally comprising:

(d) passing the wire rope through a wiping die.

3. A method according to claim 1 wherein the foamable plastic resin material is applied to the individual wires of the wire strands of the wire rope prior to the stranding of the wires together into a wire strand.

4. A method according to claim 1 in which foamable plastic resin is applied to the wire strands during the stranding of the individual wires of the strands into said strands.

5. A method of making a sealed wire strand impregnated with a plastic resin foam material and encapsulated within an outer covering of an unfoamed plastic resin material comprising:

(a) passing a plurality of individual wires into a stranding die to form said wires into a wire strand, (b) injecting an uncured foamable plastic resin material into said stranding die at a location such that it contacts the wires prior to the time they contact each other as they pass into and through the stranding die to impregnate the spaces between the wires with the foamable plastic resin material, (c) after the spaces between the wires are impregnated with foamable plasic material maintaining the individual wires together in final wire strand conformation while injecting an uncured unfoamable plastic resin material about the exterior of the wire strand in the stranding die, (d) passing the wire strand through a heating device to heat the wires, foam the foamable plastic resin material and cure the foamable and unfoamable plastic resin material.

6. A method of forming a sealed wire rope in which the individual strands are impregnated with a plastic resin foam material and the rope is encapsulated within an outer covering of an unfoamed plastic resin material comprising:

(a) impregnating a plurality of wire strands with an uncured unfoamed plastic resin material, (b) stranding the plurality of uncured unfoamed plastic resin impregnated wire strands together to form a wire rope, (c) holding the uncured unfoamed plastic resin impregnated wire strands in intimate contact with each other in a die and injecting an uncured unfoamable plastic resin composition about the strands while they are held in intimate contact, (d) passing the wire rope through a heating device wherein the uncured and unfoamed plastic composition is foamed and cured and the uncured unfoamable plastic composition is cured.

* * * * *